US011565141B2

(12) United States Patent
Miller

(10) Patent No.: US 11,565,141 B2
(45) Date of Patent: Jan. 31, 2023

(54) EXERCISE DEVICE AND SYSTEM

(71) Applicant: Waide Miller, Lake Zurich, IL (US)

(72) Inventor: Waide Miller, Lake Zurich, IL (US)

( * ) Notice: Subject to any disclaimer, the term of this patent is extended or adjusted under 35 U.S.C. 154(b) by 0 days.

(21) Appl. No.: 17/128,137

(22) Filed: Dec. 20, 2020

(65) Prior Publication Data

US 2021/0187339 A1 Jun. 24, 2021

Related U.S. Application Data

(60) Provisional application No. 62/952,192, filed on Dec. 20, 2019.

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 22/20*** | (2006.01) |
| ***A63B 21/002*** | (2006.01) |
| ***A63B 23/035*** | (2006.01) |

(52) U.S. Cl.

CPC ..... *A63B 21/0442* (2013.01); *A63B 21/0023* (2013.01); *A63B 21/00185* (2013.01); *A63B 21/0557* (2013.01); *A63B 21/4033* (2015.10); *A63B 22/20* (2013.01); *A63B 23/03516* (2013.01); *A63B 2208/0228* (2013.01)

(58) Field of Classification Search

CPC ..... A63B 21/0442; A63B 21/00185; A63B 21/0023; A63B 21/0552; A63B 21/4045; A63B 21/068; A63B 21/002; A63B 21/04; A63B 21/055–0557; A63B 21/1609; A63B 21/4033–4035; A63B 21/4049; A63B 22/20–203; A63B 23/03516; A63B 2208/0228; A63B 21/0407; A63B 21/0428; A63B 21/4011–4015; A63B 21/16–169

See application file for complete search history.

(56) References Cited

U.S. PATENT DOCUMENTS

| | | | | |
|---|---|---|---|---|
| 5,176,595 | A * | 1/1993 | Lind | A63B 22/20 482/148 |
| 5,234,394 | A * | 8/1993 | Wilkinson | A63B 21/16 482/121 |
| 5,599,260 | A * | 2/1997 | Rovinsky | A63B 21/154 482/121 |
| 5,690,594 | A * | 11/1997 | Mankovitz | A63B 21/1609 482/121 |
| 6,634,998 | B2 * | 10/2003 | Siaperas | A63B 21/04 482/142 |
| 6,767,314 | B2 * | 7/2004 | Thompson | A63B 22/0087 482/141 |
| 9,675,835 | B1 * | 6/2017 | Abramovich | A63B 21/0442 |
| 9,844,696 | B2 * | 12/2017 | Anderson | A43B 3/00 |
| 10,232,213 | B1 * | 3/2019 | Smith, Jr. | A63B 21/0442 |

(Continued)

*Primary Examiner* — Garrett K Atkinson
*Assistant Examiner* — Kathleen M Fisk
(74) *Attorney, Agent, or Firm* — Justin Lampel

(57) ABSTRACT

An exercise device and system are provided. The exercise device and system are especially suitable for use with sub-maximal to maximal concentric, isometric and eccentric exercises. The exercise device has a back-plate unit, an extended bar and a foot-brace unit. A first and second strap, each having a hand loop, may be grasped by the hands and may be attached to the extended bar and may be connected to the foot-brace unit. An optional scale may be secured to the foot-brace.

16 Claims, 6 Drawing Sheets

(56) References Cited

U.S. PATENT DOCUMENTS

| | | | | |
|---|---|---|---|---|
| 11,260,262 | B2 * | 3/2022 | Oltorik | A63B 21/0442 |
| 2004/0058788 | A1 * | 3/2004 | Thompson | A63B 21/068<br>482/96 |
| 2005/0107226 | A1 * | 5/2005 | Monda | A63B 21/04<br>482/121 |
| 2008/0214369 | A1 * | 9/2008 | Mancini | A63B 21/0552<br>482/121 |
| 2017/0151459 | A1 * | 6/2017 | Abramovich | A63B 21/4035 |
| 2021/0016133 | A1 * | 1/2021 | Wu | A63B 22/20 |
| 2021/0283457 | A1 * | 9/2021 | Merritt | A63B 21/055 |

* cited by examiner

EXERCISE DEVICE AND SYSTEM

REFERENCE TO RELATED APPLICATIONS

This application claims priority to U.S. Provisional Application No. 62/952,192 which was filed on Dec. 20, 2019, the entire contents of which are incorporated by reference herein.

BACKGROUND OF THE INVENTION

An exercise device and system are provided. The exercise device and system are especially suitable for use with sub-maximal to maximal concentric, isometric and eccentric exercises. The exercise device has a back-plate unit, an extended bar and a foot-brace unit. A first and second strap, each having a hand loop, may be grasped by the hands and may be attached to the extended bar and may be connected to the foot-brace unit. An optional scale may be secured to the foot-brace unit to determine the exerted force applied by a user.

Exercise devices are common. For example, U.S. Pat. No. 9,901,775 to Sykes discloses an isometric/isotonic neck exercise device designed to attach around a persons head, at the forehead level as would a typical headband be worn. Attached to this band as an integral component of this device to provide the medium by which the device can perform the function for which it is designed, is a nylon strap that includes two alloy "D" configuration rings for accessory attachment continuity. Once the device is secured in place on the user, accessory resistance band/s anchored from a fixed point at one end, are attached to this device with the other end of the resistance band/s to then provide a multitude of exercises that focus on all muscle groups and tendons in the neck, mid and upper spine to specifically and dramatically improve mobility and motion, for strength, fitness and rehabilitation purposes at levels which have not previously been obtained.

Further, U.S. Pat. No. 8,123,661 to Beyzavi-Armani discloses a portable isometric exercise device with resistance generated by a spring force including an electronic light or sound indicator to signal that a constant force level is being maintained. When a force is applied to the spring and a desired level of resistance is achieved, a continuous signal will be generated to advise the user that the isometric force exercise is being maintained. If the force is reduced, the signal will terminate to advise the user that the user has not maintained the required level of resistance.

Still further, U.S. Pat. No. 6,616,579 to Reinbold discloses an isometric exercise having the steps of sensing an applied force, providing a signal representing the applied force, receiving the signal and comparing the applied force to a preselected force, and providing the result of the comparison to a user in real time. The result of the comparison may be provided in an alphanumeric or other visible display, or by auditory means. The time that force is applied may be compared to a preselected time period, and a message provided to a user to rest when the preselected time period has been reached. The number of repetitions of the application of force during a session may be compared to a preselected number of repetitions, and an indication of session completion provided to a user when the number of completed repetitions equals the preselected number. A device for use in isometric exercise includes a device for sensing an applied force and providing an output signal representing the applied force, electronics for receiving the signal and comparing the applied force to a preselected force, and providing the result of the comparison to a user.

However, these patents fail to describe an exercise device and system which are easy to use and efficient as provided for in the present device and system. Further, the prior art fails to provide an exercise device and system which transfers sub-maximal to maximal concentric, isometric and eccentric loads as accomplished by the present device.

SUMMARY OF THE INVENTION

An exercise device and system are provided. The exercise device and system are especially suitable for use with sub-maximal to maximal concentric, isometric and eccentric exercises. The exercise device has a back-plate unit, an extended bar and a foot-brace unit. A first and second strap, each having a hand loop, may be grasped by the hands and may be attached to the extended bar and may be connected to the foot-brace unit. An optional scale may be secured to the foot-brace unit to determine the exerted force applied by a user.

An advantage of the present exercise device and system that the present exercise device is lightweight.

Another advantage of the present exercise device and system is that the present exercise device is durable.

Still another advantage of the present exercise device and system is that the present exercise device allows a user to exercise multiple muscles of the body with one piece of equipment.

And another advantage of the present exercise device and system is that the present exercise device and system do not require extensive time to use and build strength and muscle.

For a more complete understanding of the above listed features and advantages of the present exercise device and system reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

An exercise device and system are provided. The exercise device and system are especially suitable for use with sub-maximal to maximal concentric, isometric and eccentric exercises. The exercise device has a back-plate unit, an extended bar and a foot-brace unit. A first and second strap, each having a hand loop, may be grasped by the hands and may be attached to the extended bar and may be connected to the foot-brace unit. An optional scale may be secured to the foot-brace unit to determine the exerted force applied by a user.

Figure 5:
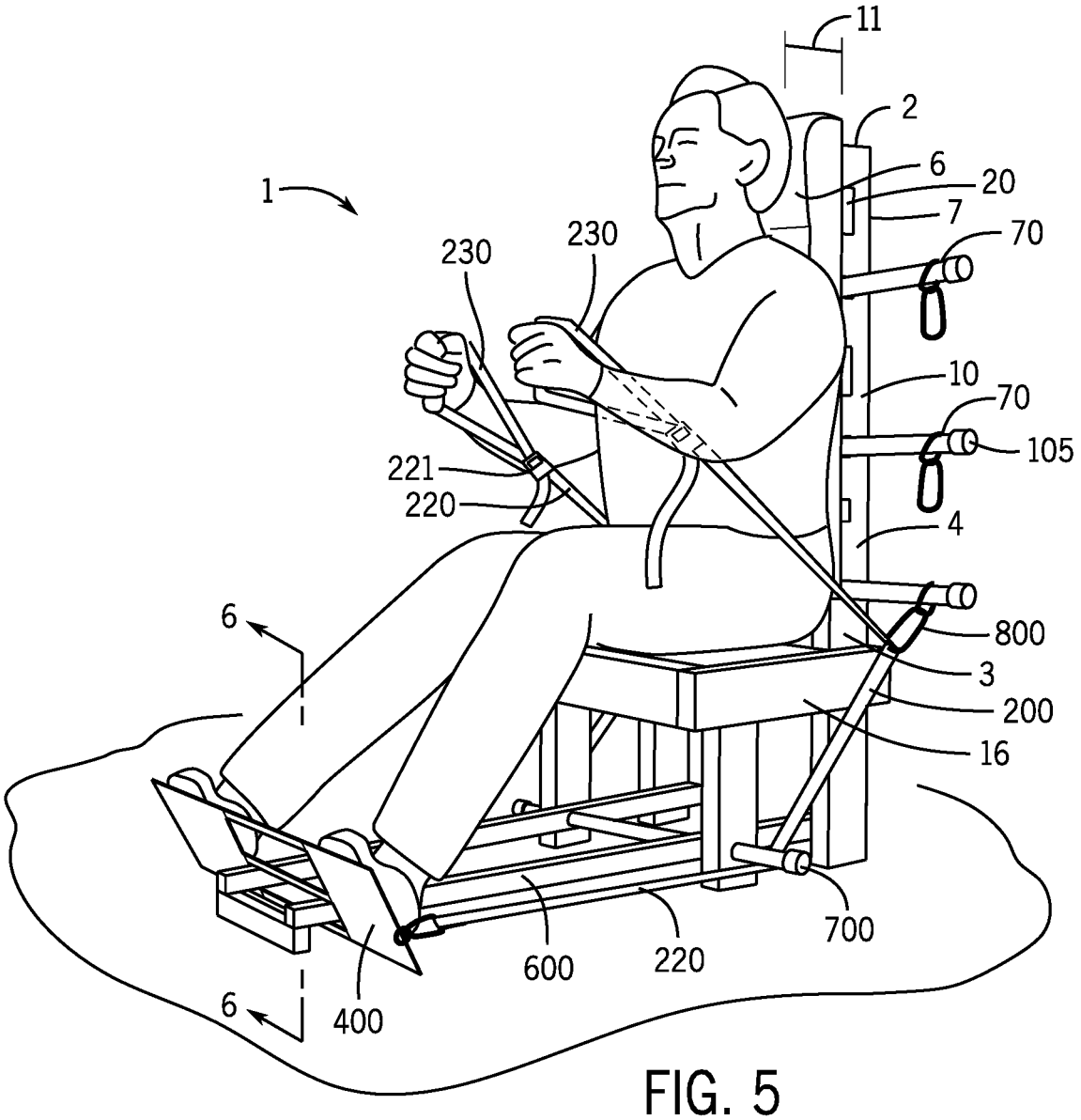
FIG. 5 illustrates a perspective view of an alternative embodiment of the exercise device wherein the foot-brace unit is secured to and runs along a rail system as opposed to having free wheels as illustrated in FIG. 1.

Referring first to FIG. 5, in an embodiment, an exercise device 1 is provided. The device 1 may have a back-plate unit 10. The back-plate unit 10 is illustrated as being made of wood, however, the back-plate unit 10 may be made of various other materials, such as, plastic, rubber, metal or the like. The back-plate unit 10 may have a top 2, a bottom 3, a first side 4, a second side (not visible), a front 6 and a back 7. Further, the back-plate unit 10 may have a width 11 defining the distance from the front 6 to the back 7. In one embodiment, the back-plate 10 may be secured to a seat unit 16. In other embodiments (such as FIG. 7) the device 1 may lack a seat and be secured directly to the wall 1000 (FIG. 7) and wherein a user provides his/her own seat.

In an embodiment, the back-plate unit 10 may have at least a first elongated channel 20. The elongated channel 20 may extend from the first side 4 of the back-plate unit 10 to the second side of the back-plate unit 10. Although the illustrations generally show six elongated channels 20, a greater or fewer number of elongated channels 20 may be present on the back plate 10. In an embodiment, the elongated cannel 20 may receive an elongated bar 70 as discussed below. In FIG. 5, three elongated bars 70 are illustrated occupying three of the six, preferably parallel, elongated channels 20. A user may select which channels 20 to move one or more of the elongated bars 70 to so that a user may adjust his/her workout according to a specific desire. For example, a user may work his/her shoulders by using the upper most channel 20 while a user 300 may work his/her chest by selecting a lower channel 20 to insert the elongated bar 70.

Figure 9:
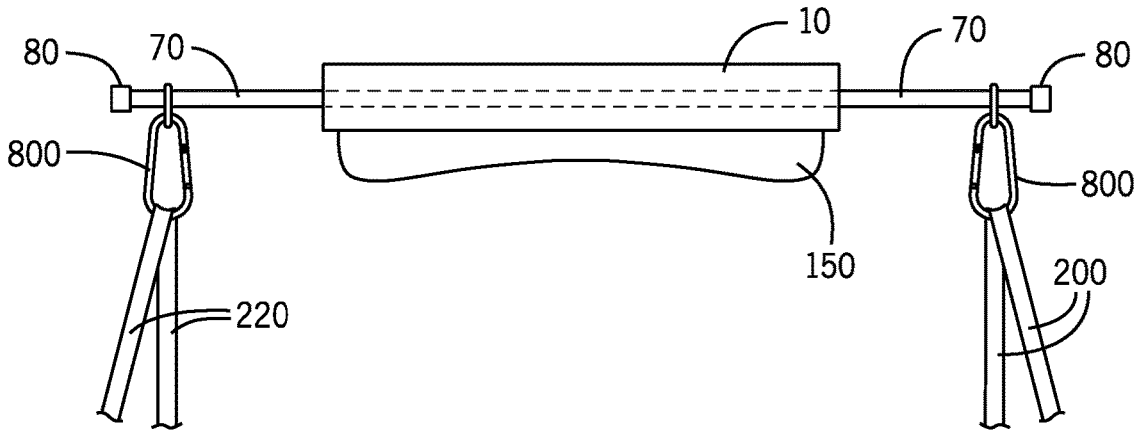
FIG. 9 illustrates a top view of the back-plate with both the first and second weight straps shown attached to the carabiners/clips.

The elongated bar 70 may have two sides 80 (only FIG. 9 illustrates both sides of the elongated bar 70) which are generally mirror images and connected as a single bar in one embodiment. In particular, the elongated bar 70 may extend through the elongated channel 20 so that the first side 80 of the elongated bar 70 extends from the first side 4 of the back-plate unit 10 while the second side of the elongated bar 70 extends from the second side of the back-plate unit 10.

In an embodiment, the first side 80 of the elongated bar 70 may have a first end cap 105 and the second side of the elongated bar 70 may have a second end cap (shown in FIG. 9). The first and second end caps 105 may have a diameter 125 (FIG. 1) which is greater than the diameter of the elongated bar 70 so that straps (as described below) do not accidentally slip off the ends of the first side 80 or second side of the elongated bar 70 during use of the apparatus 1 if a user decides to secure the straps around the bar, as opposed to through carabineers/clips 800 that will be described below.

Figure 1:
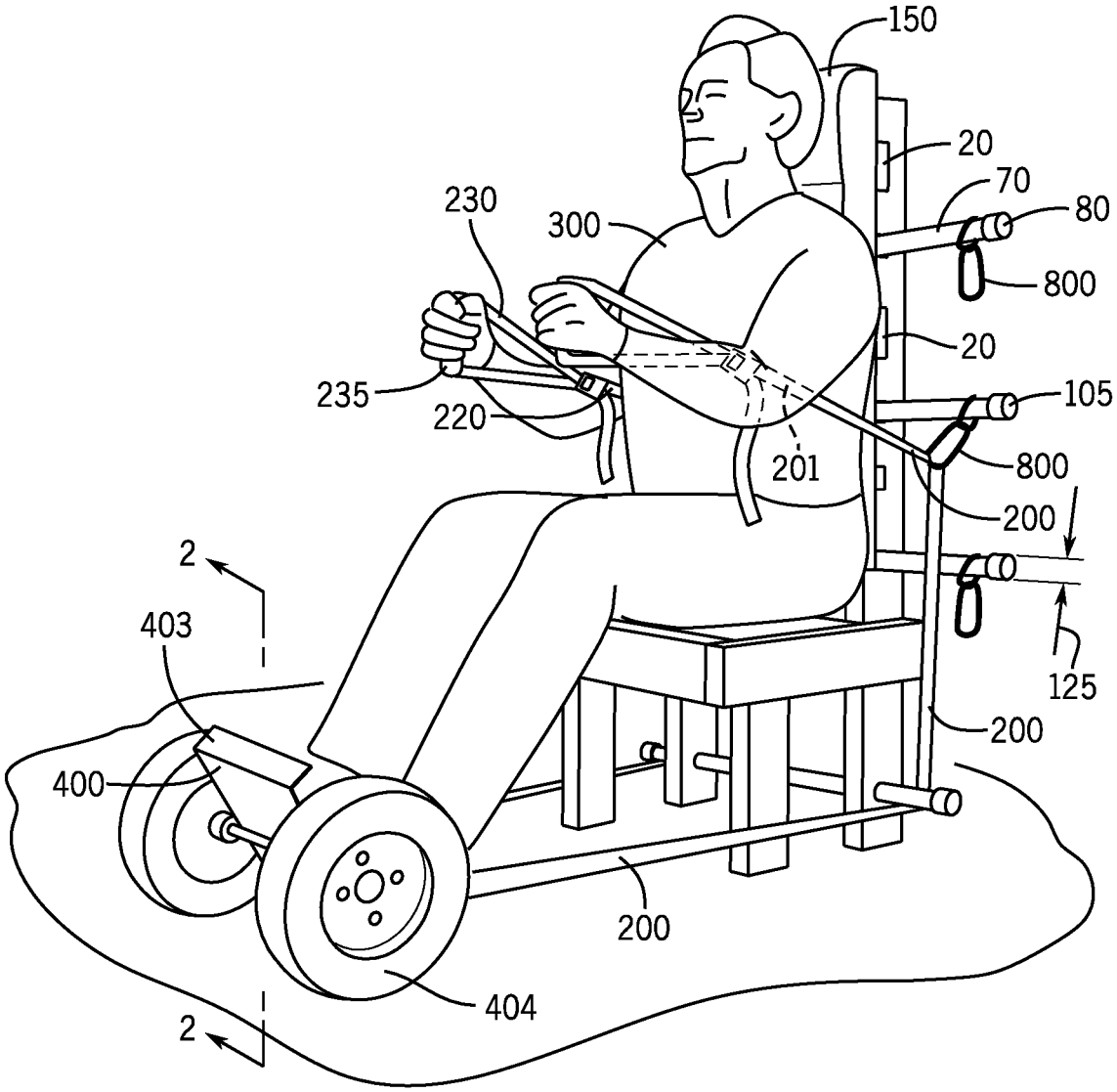
FIG. 1 is a perspective view of the present exercise device wherein a user is in the process of using the device and wherein wheels are attached to the foot-brace unit in one embodiment.

In an embodiment, the back-plate unit 10 may have a padded section 150 (FIG. 1). The padded section 150 may be secured to the front 6 of the back-plate 10 and may provide increased comfort to the user 300 while the user 300 is using the apparatus 1 to perform an exercise.

In an embodiment, the device 1 may have a plurality of straps. In particular, the device 1 may have a first weight strap 200 and a second weight strap 220. The first weight strap 200 and second weight strap 220 may have loop portions 230 which may include a handle 235 for grasping. In an embodiment, the first weight strap 200 and the second weight strap 220 may be, for example, a rope, wire or cable or the like. Further, the first weight strap 200 and the second weight strap 220 may be largely inelastic so as to facilitate a more direct transfer of force to the use and to further increase safety to the user.

Figure 2:
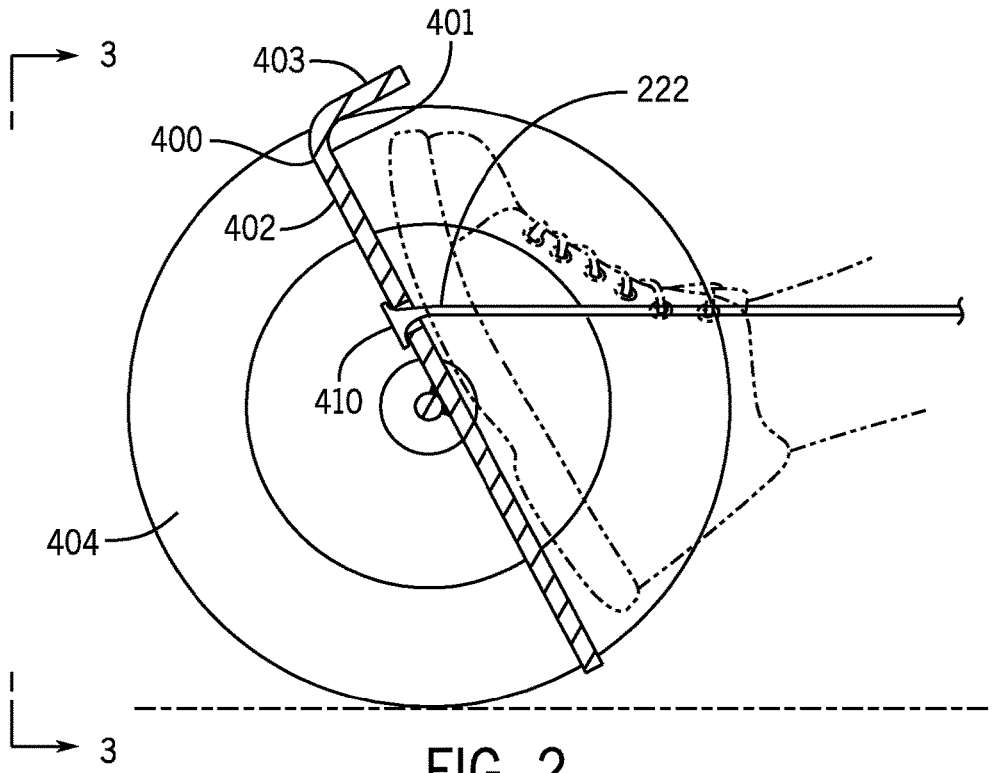
FIG. 2 is side view of the foot-brace unit of the present device wherein the user's foot is shown in phantom for illustrative purposes.
Figure 3:
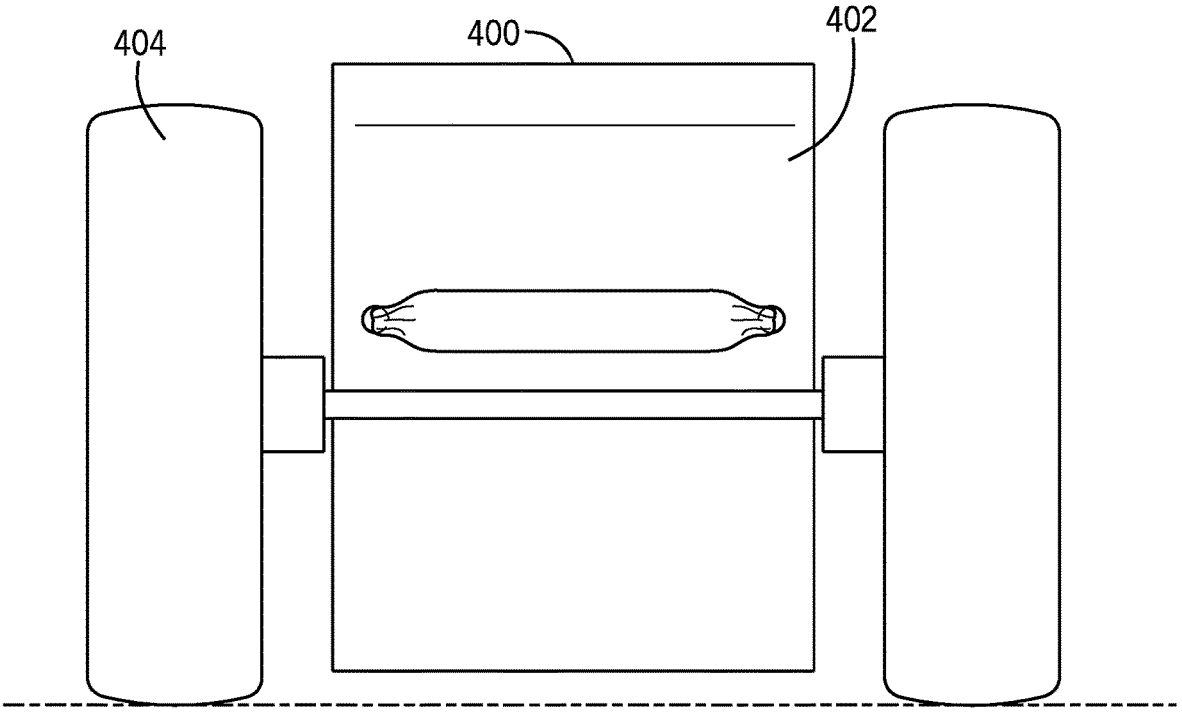
FIG. 3 is view of the bottom of the foot-brace unit of the exercise device.

Referring now to FIGS. 1 and 2, in an embodiment the first weight strap 220 may have a first end 201 and a second end 222 (FIG. 2). The second weight strap 220 may also have a first end 221 (FIG. 5) and a second end (not visible). Preferably, the first weight strap 200 and second weight strap 220 have a buckle unit 225 (FIG. 7) which allows a user to adjust the overall length of each of the weight straps 200, 220. Adjusting the overall length of the first and the second weight strap 200, 220 allows users of different heights to utilize the device 1. Further, adjusting the overall length of the first and the second weight straps 200, 220 allows the straps 200, 220 to be used for different exercises.

As stated above, a user may adjust the overall length of the first and the second weight straps 200, 220. A user may also extend the overall length of the first and second weight strap 200, 220 so that the user's 300 hands are in the gripping loops 230 of the straps 200, 220. Once in position as shown in FIG. 1, a user may pull upward and/or forward to create a sub-maximal to maximal concentric contraction transitioning to a sub-maximal to maximal isometric contraction then ultimately to a sub-maximal to maximal eccentric contraction exercise. At the same time or after the user pulls upward and/or forward with his/her hands, the user may then press his/her feet forward therein creating tension on the straps 200, 220 and performing an exercise.

In an embodiment, the user 300 may clip the first and the second weight straps 200, 220 to carabiners or clips 800 located on the two sides 80 of the elongated bar 70. The weight straps 200, 220 may move through the carabiners or clips 800 during an exercise. Typically, a user uses the carabiners or clips 800 to secure the first and second weight straps 200, 200; however, in an embodiment a user may simply wrap the first and second weight straps 200, 220 around the elongated bar 70 instead of using the clips 800. In an embodiment the carabiners or clips 800 may be "smart" carabiners or clips 800 having computers with internal electric circuitry which measures and records the amount of pull received on the carabiners or clips 800 and may transmit that data to a computer for monitoring and storing. Further, in one embodiment, the first and the second weight straps 200, 220 may have optional digital sensors. The sensors may record pressure, time of pressure and other data related to the workout and may send that information to a computerized device for analysis.

In an embodiment, the straps 200, 220 may initially remain largely stationary as a user slowly builds and increases muscular tension (to maintain safety via the omission of the concussion of forces) by exerting sub-maximal to maximal execution of a concentric contraction while the user is both pushing with his/her arms and feet at the same time. Once sub-maximal to maximal concentric contraction has terminated full-body sub-maximal to maximal isometric contraction is achieved; the user may then begin extending at the knee and hip joints using largely the gluteal and quadriceps muscles to provide from sub-maximal eccentric loading of the upper body (specifically, the chest, shoulder and tricep muscles as shown in FIG. 1).

Referring now to FIG. 2, in an embodiment, a foot-brace unit 400 is provided. The foot-brace unit 400 may have a top surface 401, a bottom surface 402 and, preferably, two wheels 404 attached to the sides of the foot-brace unit 400. A securing device 410 may be located on each side of the foot-brace unit 400 to receive the second ends of the two weight straps 200, 220.

Figure 4:
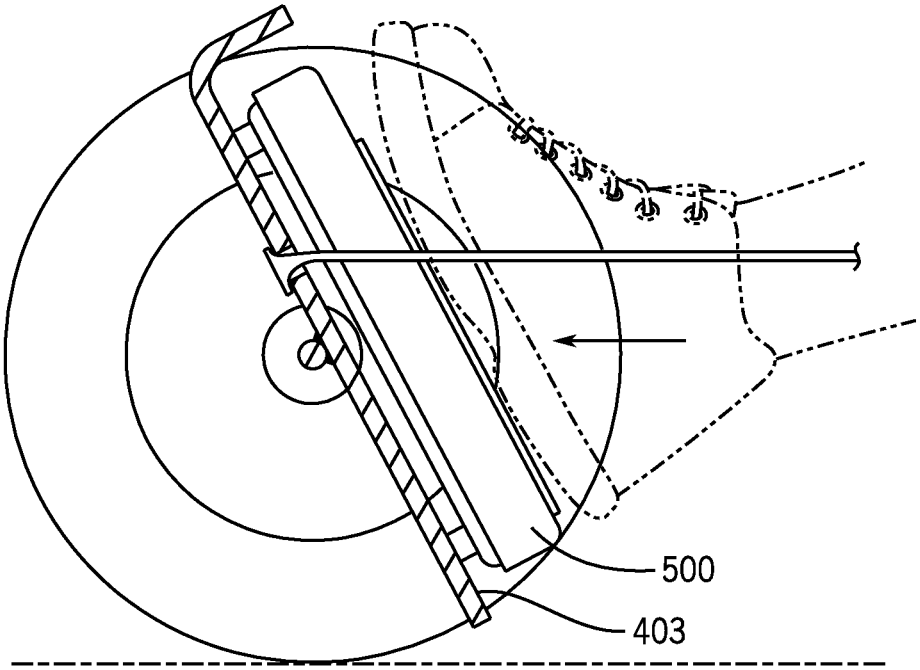
FIG. 4 is a side view of the foot-brace unit wherein an optional scale is added to the top surface of the foot-brace unit.

The user 300 may place his/her foot on the top surface 401 of the foot-brace unit 400 when the foot-brace unit 400 is secured to the straps 200, 220 and the straps 200, 220 are clipped through the clips 800 of the elongated bar 70. The user 300 then holds the handles 235 and may begin the exercise. In an embodiment, a foot-brace unit 400 has at least a first elongated extending (or "raised") edge 403. The elongated extending edge 403 may be used to secure an optional scale 500 (FIG. 4). In particular, the user 300 may use the device 1 with or without the scale 500. When the device 1 is used without the scale 500, the user 300 directly places his/her feet on the top surface 401 of the foot-brace unit 400 as shown in FIG. 1. If the optional scale 500 is desired, the user 300 places the scale 500 on the foot-brace unit 400 and places his/her feet on the scale 500. The elongated edge 403 prevents the scale 500 from slipping during use. In an embodiment, the foot-brace unit 400 is reversible so that the elongated edge 403 may be used on the bottom of the foot-brace unit 400 to hold the sale 500 (the figures illustrate the edge at the top end of the foot-brace unit 400). When the user 300 presses his/her feet while performing an exercise, the scale 500 will inform the user 300 of the total pressure (for example, pounds) exerted so that the user 300 may document the exerted pressure and exercise accordingly during that session or a future work-out session.

Figure 6:
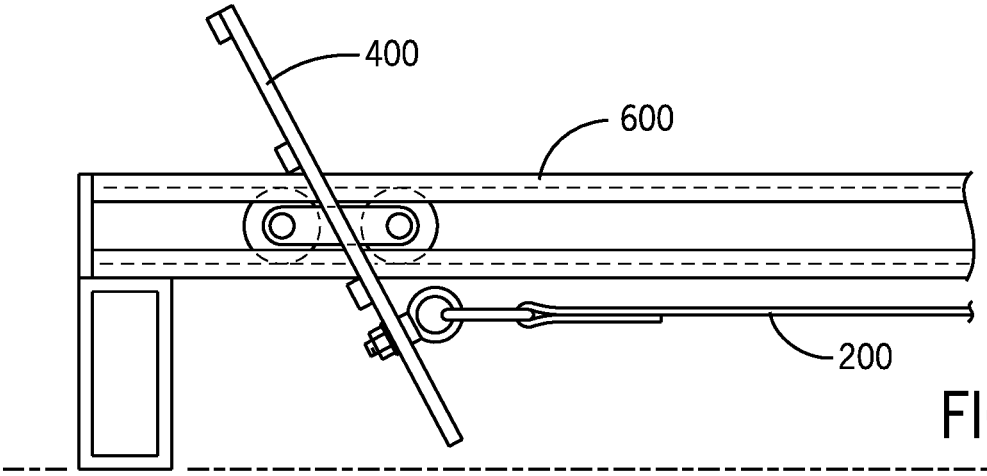
FIG. 6 illustrates a side view of the rail system of the foot-brace unit in one embodiment.

Referring now to FIGS. 5 and 6, in an alternative embodiment, the foot-brace unit 400 may be attached and secured to a rail system 600. The rail system 600 may allow the foot-brace unit 400 to move from a first position to a second position in a specific forward and backward manner so as to avoid the foot-brace unit 400 (in the wheel embodiment) from accidentally sliding or moving suddenly. This embodiment requires more space while the embodiment of FIG. 1 is more easily store and transported.

Figure 7:
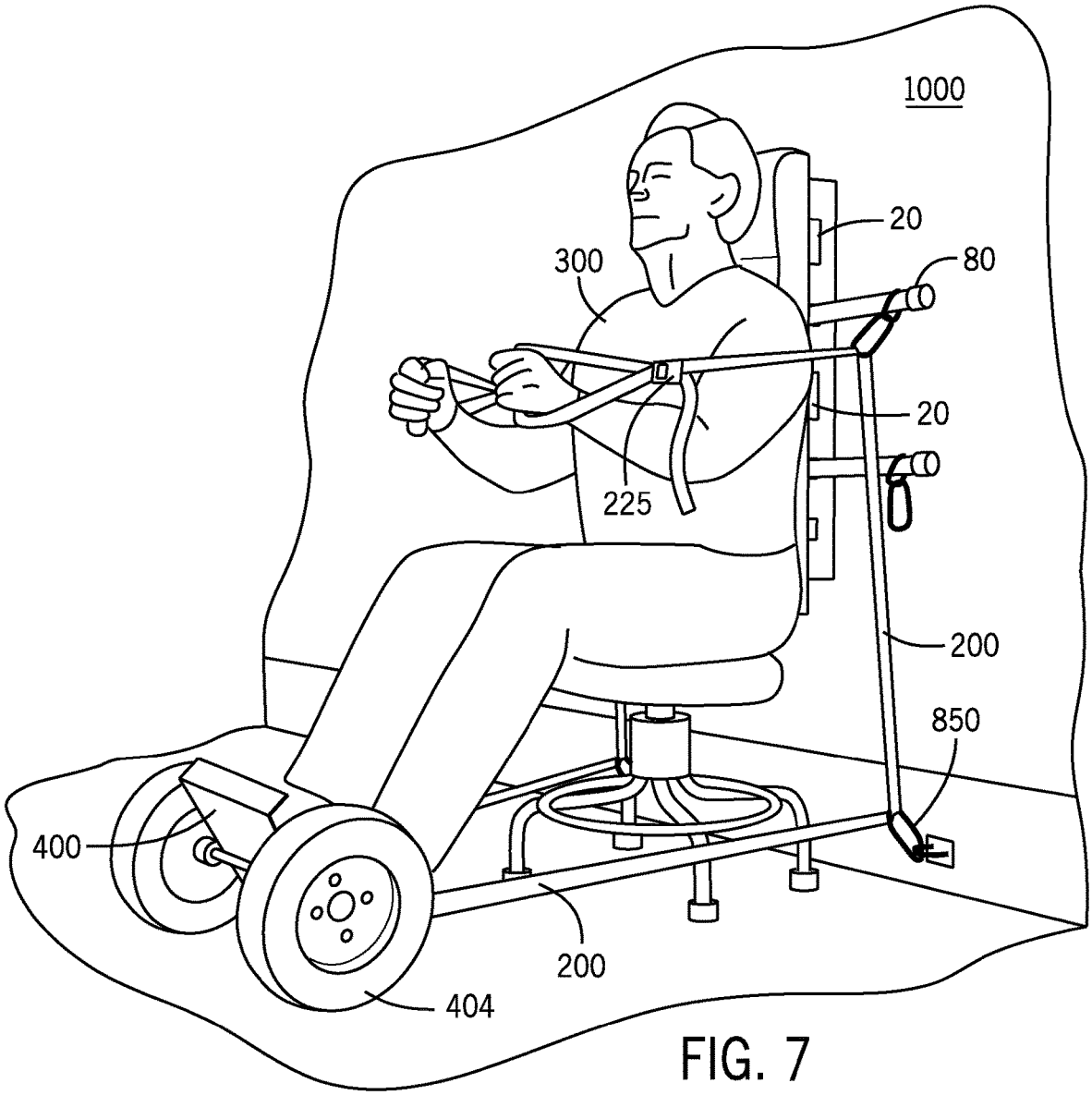
FIG. 7 illustrates an alternative embodiment wherein the back-plate is secured directly to a wall in one embodiment.

In one embodiment, a foot-bar 700 (FIG. 5) may be attached to the device 1 near the floor. In one embodiment, the foot-bar 700 is secured to the seat of the device 1. The foot-bar 700 may direct the straps 200, 220 so that the straps 200, 220 move in a parallel manner with respect to the foot-brace unit 400 and, therefore, prevent the foot-brace unit 400 from moving in an improper direction during the exercise. In an alternative embodiment, a lower set of carabiners or clips 850 (FIG. 7) may be used to change the direction of the first and second weight straps 200, 220 as opposed to the foot-bar 700 of FIG. 1. In this embodiment, the lower set of carabiners or clips 850 may even be secured directly to the wall 1000 as shown in FIG. 7.

Figure 8:
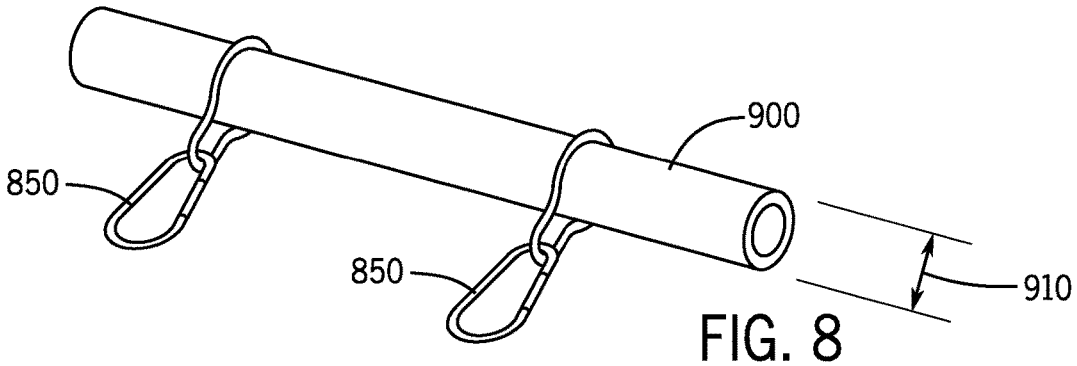
FIG. 8 illustrates a securing tube as used on one embodiment wherein a user secures the securing tube under a door.
Figure 10:
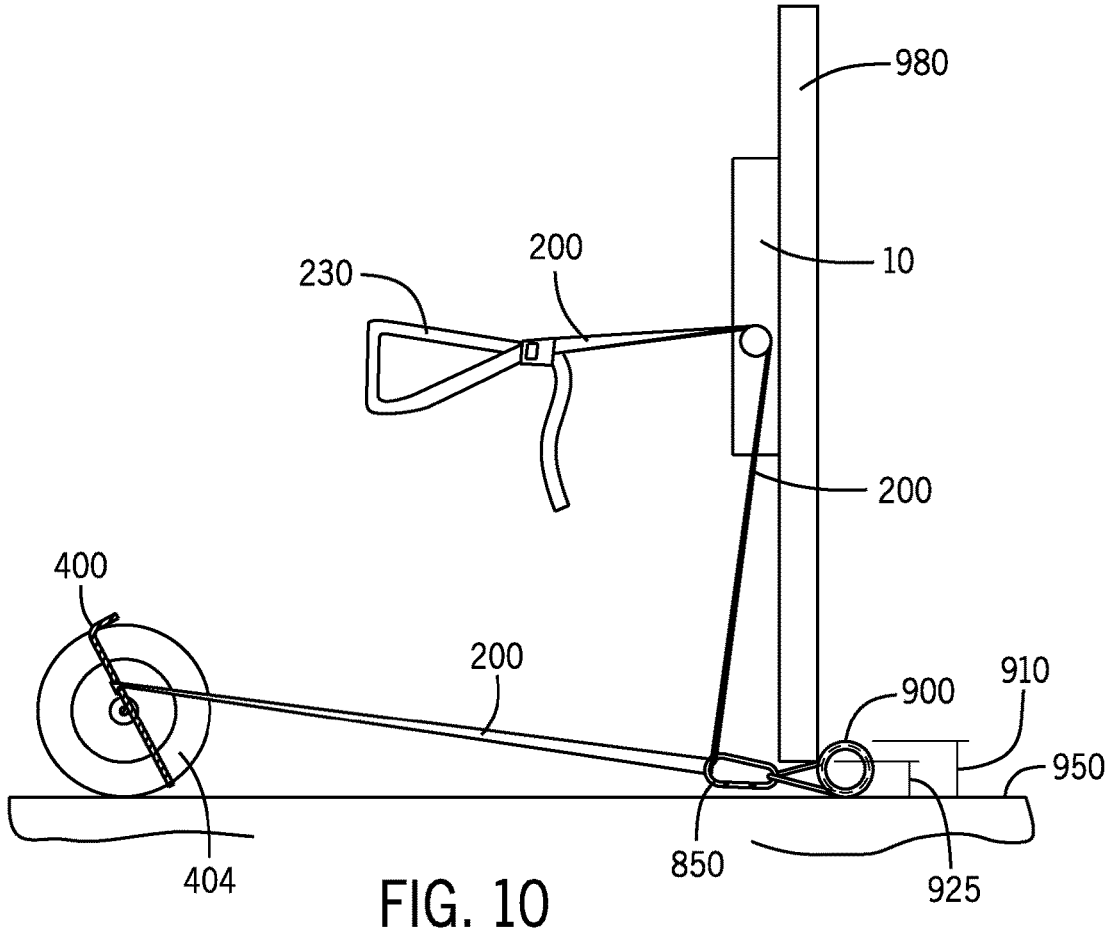
FIG. 10 illustrates a side view of the alternative embodiment of use of the device and system wherein the system uses the securing tube of FIG. 8 under a door to secure the lower portions of the straps.

Referring now to FIGS. 8 and 10, in one embodiment, a user may use a closed door 980 while using the exercise apparatus 1. In particular, an elongated tube 900 having a diameter 910 may be used in connection with the exercise apparatus 1. The diameter 910 of the elongated tube 900 is greater than a width 925 between the bottom of a door 980 and the floor 950 so that the elongated tube 900 remains behind a closed and secured door 980. In this embodiment, the elongated tube 900 directs the movement of the straps 200, 220 in a similar manner as the carabineers or clips of FIG. 7 or the foot-bar 700 of FIG. 5. In an embodiment, the elongated tube 900 may have a square or other shaped cross section so that the elongated tube 900 is less likely to move during use.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. An exercise device comprising:

a back-plate unit having a front, a back, a first side, a second side, a top and a bottom;

a first opening channel extending from the first side to the second side of the back-plate unit;

an extended bar having a first end and a second end wherein the extended bar is located within the first opening channel;

a strap having a first end and a second end wherein the strap is secured to the extended bar;

a foot-brace unit having a top edge configured to be positioned towards toes of a user's foot and a bottom edge configured to be positioned towards a heel of the user's foot wherein the second end of the strap is secured to the foot-brace unit; and a raised edge on the foot-brace unit wherein the foot-brace unit is reversible so that the raised edge is located on the top edge of the foot-brace unit or on the bottom edge of the foot-brace unit.

2. The exercise device of claim 1 further comprising:

a second strap having a first end and a second end where in the second strap is secured to the extended bar.

3. The exercise device of claim 1 further comprising:

a carabineer or clip attached to the extended bar wherein the carabineer or clip secures the strap.

4. The exercise device of claim 1 further comprising:

a wheel attached to the foot-brace unit.

5. The exercise device of claim 1 further comprising:

a second opening channel extending from the first side to the second side of the back-plate unit and parallel to the first opening channel wherein the second opening channel is configured to receive the extended bar and wherein the extended bar is capable of occupying either of the opening channels.

6. The exercise device of claim 1 further comprising:

a handle located on the first end of the strap.

7. The exercise device of claim 1 further comprising:

a seat attached to the back-plate unit.

8. The exercise device of claim 1 further comprising:

a second extended bar located on a seat of the exercise device wherein the strap passes behind the second extended bar and allows the strap to move in a parallel manner with respect to the foot-brace unit.

9. The exercise device of claim 1 further comprising:

a computer associated with a carabineer or a clip wherein the computer records the amount of pressure that the carabineer or clip receives during an exercise.

10. The exercise device of claim 1 further comprising:

a rail wherein the foot-brace unit moves from a first position to a second position along the rail.

11. The exercise device of claim 1 further comprising:

an extended tube wherein the extended tube has a width and wherein the extended tube has a carabineer or clip wherein the extended tube is secured behind a closed door.

12. The exercise device of claim 1 further comprising:

a padded cushion located on the front of the back-plate unit.

13. The exercise device of claim 1 further comprising:

an adjustable buckle on the strap wherein the adjustable buckle allows a length of the strap to be altered.

14. The exercise device of claim 1 further comprising:

a cap located at an end of the elongated bar.

15. An exercise device comprising:

a back-plate unit having a front, a back, a first side, a second side, a top and a bottom;

a first opening channel extending from the first side to the second side of the back-plate unit;

an extended bar having a first end and a second end wherein the extended bar is located within the first opening channel;

a strap having a first end and a second end wherein the strap is secured to the extended bar;

a foot-brace unit wherein the second end of the strap is secured to the foot-brace unit; and a raised edge on the foot-brace unit wherein the raised edge secures a removable scale which is placed on a top surface of the foot-brace unit.

16. An exercise device comprising:

a back-plate unit having a front, a back, a first side, a second side, a top and a bottom;

a first opening channel extending from the first side to the second side of the back-plate unit;

an extended bar having a first end and a second end wherein the extended bar is located within the first opening channel;

a strap having a first end and a second end wherein the strap is secured to the extended bar;

a foot-brace unit wherein the second end of the strap is secured to the foot-brace unit; and a second extended bar located on a seat of the exercise device wherein the strap passes behind the second extended bar and allows the strap to move in a parallel manner with respect to the foot-brace unit.

* * * * *